US006626723B2

(12) United States Patent
Yoneda

(10) Patent No.: US 6,626,723 B2
(45) Date of Patent: Sep. 30, 2003

(54) METHOD OF MAKING ELECTROLUMINESCENT LAMP

(75) Inventor: Koji Yoneda, Ichikawa (JP)

(73) Assignee: Seiko Precision, Inc., Narashino (JP)

( * ) Notice: Subject to any disclaimer, the term of this patent is extended or adjusted under 35 U.S.C. 154(b) by 0 days.

(21) Appl. No.: 10/215,786

(22) Filed: Aug. 9, 2002

(65) Prior Publication Data

US 2003/0006700 A1 Jan. 9, 2003

Related U.S. Application Data

(62) Division of application No. 09/548,874, filed on Apr. 13, 2000, now Pat. No. 6,476,552.

(30) Foreign Application Priority Data

Apr. 14, 1999 (JP) ..... 11-107164

(51) Int. Cl.[7] ..... H05B 33/10; H05B 33/22; H05B 33/28

(52) U.S. Cl. ..... 445/24; 427/66

(58) Field of Search ..... 445/24, 25; 427/66; 313/504, 509, 506; 428/690, 917

(56) References Cited

U.S. PATENT DOCUMENTS 3,037,138 A * 5/1962 Motson ..... 313/509
4,482,580 A * 11/1984 Emmett et al. ..... 427/66
4,482,841 A * 11/1984 Tiku et al. ..... 313/506
4,741,976 A * 5/1988 Eguchi et al. ..... 313/504
5,976,613 A * 11/1999 Janusauskas ..... 427/66
6,476,552 B1 * 11/2002 Yoneda ..... 313/509

FOREIGN PATENT DOCUMENTS

JP 7106068 4/1995

* cited by examiner

*Primary Examiner*—Kenneth J. Ramsey
*Assistant Examiner*—Mariceli Santiago
(74) *Attorney, Agent, or Firm*—Schulte Roth & Zabel LLP; Joel E. Lutzker; Donna L. Angotti

(57) ABSTRACT

The difference of luminance between a front surface side and a rear surface side as viewed from the front surface side is reduced in a multi-layered EL lamp. An EL lamp includes a first laminate formed by serially laminating a first transparent electrode, a first luminescent layer and a first insulating layer, a second laminate formed by serially laminating a second transparent electrode, a second luminescent layer and a second insulating layer on the first laminate, and a rear electrode formed on the second laminate, wherein a dielectric constant between the first and second transparent electrodes is set to a value smaller than a dielectric constant between the second transparent electrode and the rear electrode. This can be achieved by limiting the amount of a high dielectric material to be mixed in the first insulating layer to not greater than 90% in terms of a weight ratio of a high dielectric material mixed in the second insulating layer, or by increasing the thickness of the first luminescent layer to 130 to 250% of the thickness of the second luminescent layer. After the adjustment is made in this way, the thickness of the first insulating layer may be set to not greater than 90% of the thickness of the second insulating layer or may be omitted.

13 Claims, 4 Drawing Sheets

METHOD OF MAKING ELECTROLUMINESCENT LAMP

The is a divisional application of patent application Ser. No. 09/548,874 filed Apr. 13, 2000 and now U.S. Pat. No. 6,476,552.

BACKGROUND OF THE INVENTION

1. Field of the Invention

This invention relates to an electroluminescent lamp (hereinafter referred to as an "EL lamp").

2. Description of the Related Art

EL lamps in general allow a luminescent body inside a luminescent layer to emit rays of light by an alternating electric field by laminating the luminescent layer and an insulating layer between a transparent electrode and a rear electrode. A multi-layered EL lamp is known that includes a plurality of laminates each comprising the transparent electrode, the luminescent layer and the insulating layer, and allows these laminates to emit the rays of light either independently or simultaneously in a plane of the multi-layered EL lamp. A multi-color multi-layered EL lamp having the two-layered structure, that is disclosed in Japanese Patent No. 2,696,056, is one of the EL lamps of this kind.

Generally, when the multi-layered EL lamp comprises two laminates, luminescence of one, or both, of a first laminate (front surface side) and a second laminate (rear surface side) constituting the EL lamp is viewed from either one of the surface sides. Luminescence of the rear surface side can be viewed as luminescence passing through the laminate disposed on the front surface side and vice-versa. Therefore, if luminance from each laminate is equal, the luminance when viewed from a particular side naturally appears different between the case where the front surface side is allowed to emit light and the case where the rear surface side is allowed to emit light.

When the thickness of the laminate on the front surface side, for example, is decreased to reduce the difference of luminance between the front surface side and the rear surface side of the laminates in the multi-layered EL lamp when viewed from the front, or to prevent as much as possible the rays of light of the rear surface side from being intercepted by the laminate on the front surface side, the quantity of transmitting light from the rear surface side when viewed from the front increases. However, because the constituent film of the laminate on the front surface side is thin, an impressed voltage of the luminescent layer on the front surface side increases, and luminescence of the front surface side itself increases. Consequently, the difference of luminescence of both laminates as viewed from the front surface side cannot be decreased. Further, when the thickness of the laminate on the front surface side is decreased, deterioration on the front surface side is promoted, causing a difference of service life between the laminate on the front surface side and the laminate on the rear surface side.

SUMMARY OF THE INVENTION

To solve the problems described above, the present invention makes luminance of laminates of a multi-layered EL lamp different between the front surface side and the rear surface side. Namely, the present invention sets a dielectric constant for emitting light on the front surface side to a value smaller than a dielectric constant for emitting light on the rear surface side so that the difference of luminance between the front surface side and the rear surface side as viewed from the front surface side can be decreased. The present invention sets such a difference of the dielectric constants by adjusting mixing ratios of a high dielectric material to be mixed in the laminates constituting the EL lamp on the front and rear surface sides, or by changing the thickness of respective luminescent layers.

An EL lamp according to the present invention comprises a first laminate formed by laminating serially a first transparent electrode, a first luminescent layer and a first insulating layer, a second laminate formed by laminating serially a second transparent electrode, a second luminescent layer and a second insulating layer on the first laminate, and a rear electrode formed on the second laminate, wherein a dielectric constant between the first transparent electrode and the second transparent electrode is smaller than a dielectric constant between the second transparent electrode and the rear electrode.

To set the dielectric constant between the first transparent electrode and the second transparent electrode to a value smaller than the dielectric constant between the second transparent electrode and the rear electrode, the amount of the high dielectric material to be mixed in the first insulating layer is preferably not greater than 90% of the amount of the high dielectric material to be mixed in the second insulating layer.

To set the dielectric constant between the first transparent electrode and the second transparent electrode to a value smaller than the dielectric constant between the second transparent electrode and the rear electrode, the thickness of the first luminescent layer is preferably 130 to 250% of the thickness of the second luminescent layer.

Furthermore, the thickness of the first insulating layer is preferably not greater than 90% of the thickness of the second insulating layer to set the dielectric constant between the first transparent electrode and the second transparent electrode to a value smaller than the dielectric constant between the second transparent electrode and the rear electrode, and to improve transmission luminance of the second laminate that can be viewed through the first laminate.

DESCRIPTION OF THE PREFERRED EMBODIMENTS

Figure 1:
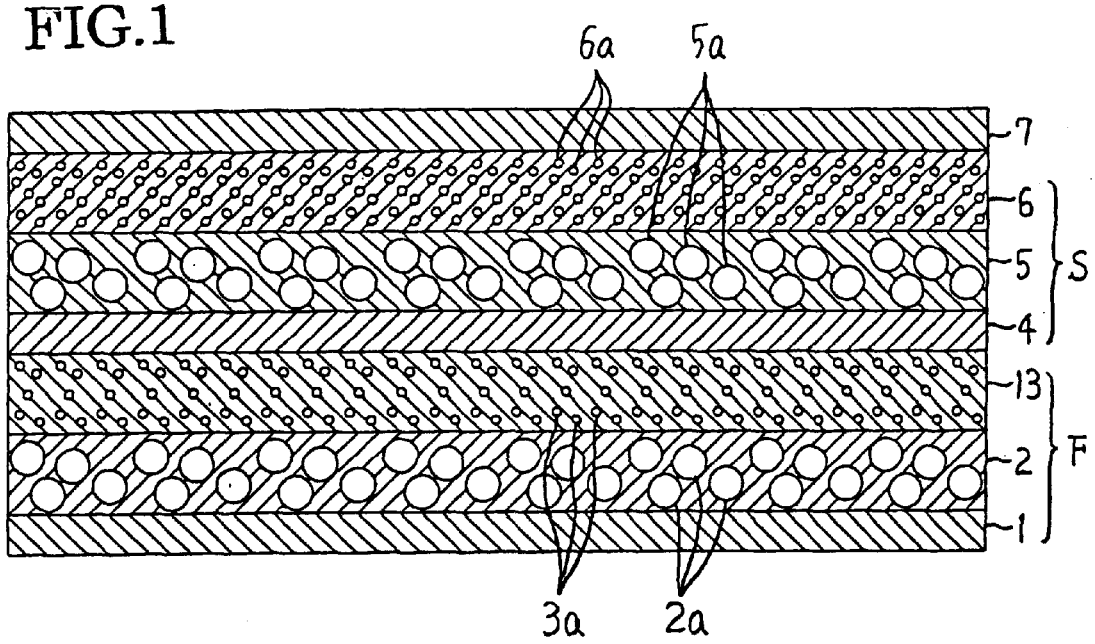
FIG. 1 is a schematic sectional view showing a multi-layered EL lamp in which the amount of a high dielectric material to be mixed in a first insulating layer (on the front surface side) is smaller than in a second insulating layer (on the rear surface side)

Hereinafter, EL lamps according to the preferred embodiments of the present invention will be explained with reference to the accompanying drawings in which like reference numerals denotes corresponding elements.

Embodiment 1:

The first embodiment of the invention is based on the concept that the amount of a high dielectric material mixed in a first insulating layer is smaller than the amount in a second insulating layer so that a dielectric constant between a first transparent electrode 1 and a second transparent electrode 4 can be set to a value smaller than the dielectric constant between the second transparent electrode 4 and a rear electrode 7.

The first transparent electrode 1 is formed by evaporating an indium-tin oxide (hereinafter called "ITO") on a polyethylene terephthalate (PET) film, as depicted in FIG. 1.

A first luminescent layer 2 is formed and laminated on the first transparent electrode 1 by laminating luminescent ink on the upper surface of the first transparent electrode 1 by screen printing. This luminescent ink is prepared by mixing and stirring 60 g of a luminescent body 2*a* made of zinc sulfide (ZnS) doped with Cu and 35 g of a fluorocarbon resin binder. The fluorocarbon resin binder is prepared, in turn, by dissolving 10 g of a copolymer of vinylidene fluoride and propylene hexafluoride in 25 g of 2-(2-n-butoxyethoxy) ethyl acetate as a solvent. This luminescent ink is printed on the upper surface of the first transparent electrode 1 by screen printing, or like means, and is then heat-dried to produce the first luminescent layer 2.

A first insulating layer 13 is formed and laminated by printing insulating ink on the upper surface of the first luminescent layer 2. The insulating ink is prepared by mixing and stirring 36 g of a high dielectric material made of barium titanate ($BaTiO_3$) and 48 g of the fluorocarbon resin binder described above. The insulating ink is printed on the upper surface of the first luminescent layer 2 and is then heat-dried to produce the first insulating layer 13.

The mixing amount (weight ratio) of barium titanate for forming the first insulating layer 13 is smaller than the mixing amount of a later-appearing second insulating layer. The detail is described herein.

A first laminate F comprising the first transparent electrode 1, the first luminescent layer 2 and the first insulating layer 13 is thus formed.

Next, a second transparent electrode 4 is formed and laminated by printing transparent electrode ink on the upper surface of the first insulating layer 13. The transparent electrode ink is prepared by mixing an ITO crystal in an epoxy type binder (two-component curing type). The transparent electrode ink is printed on the upper surface of the first insulating layer 13 by screen printing, or the like, and is then heat-dried to produce a second transparent electrode 4.

The binder for constituting the second transparent electrode 4 of the second laminate S is the epoxy type binder (two-component curing type) having high chemical resistance. However, the binder is not particularly limited thereto. For example, resins having a polymer structure such as UV-curable resins, thermosetting resins and visible ray-curable resins can be used so long as they are resistant to the ITO crystal and to the solvent of the ink for forming the second luminescent ink to be described.

A second luminescent layer 5 is formed and laminated on the upper surface of the second transparent electrode 4 by printing luminescent ink (the "second luminescent ink") on the upper surface of the second transparent electrode 4. The luminescent ink is prepared by mixing and stirring 60 g of a luminescent body 5*a* made of zinc sulfide (ZnS) doped with Cu and 35 g of a fluorocarbon resin binder in the same way as in the first luminescent layer 2. The fluorocarbon resin binder is prepared by dissolving 10 g of a copolymer of vinylidene fluoride and propylene hexafluoride in 25 g of 2-(2-n-buthoxyethoxy) ethyl acetate as the solvent in the same way as the first luminescent layer 2. This luminescent ink is printed on the upper surface of the second transparent electrode 4 by screen printing, or like means, and is then heat-dried to produce the second luminescent layer 5.

A second insulating layer 6 is formed and laminated on the upper surface of the second luminescent layer 5 by printing insulating ink on the upper surface of the second luminescent layer 5. This insulating ink is prepared by mixing and stirring 60 g of a high dielectric material 6*a* made of barium titanate ($BaTiO_3$) and 48 g of the fluorocarbon resin described above in the same way as the first insulating layer 13. This insulating ink is printed on the upper surface of the second luminescent layer 5 by screen printing, or like means, and is then heat-dried to produce the second insulating layer 6.

The second laminate S comprising the second transparent electrode 4, the second luminescent layer 5 and the second insulating layer 6 is thus formed.

A rear electrode layer 7 is formed and laminated on the upper surface of the second insulating layer 6 by printing carbon ink. This carbon ink is prepared by mixing carbon powder with polyester as a binder. Incidentally, carbon ink prepared by mixing carbon powder, silver powder and polyester as a binder can also be used.

When an alternating electric field is applied between the first transparent electrode 1 and the second transparent electrode 4 in the construction described above, the first luminescent layer 2 emits rays of light. When an alternating electric field is applied between the second transparent electrode 4 and the rear electrode 7, the second luminescent layer 5 emits rays of light. When the alternating electric field is applied between the first transparent electrode 1 and the rear electrode layer 7, the first and second luminescent layers 2 and 5 emit rays of light.

Next, the mixing amount of the high dielectric materials 3*a* and 6*a* to be mixed for forming the first and second insulating layers 13 and 6 will be explained in detail. In the multi-layered EL lamp, light emission is viewed from either one or both sides of the EL lamp, i.e. from the side of the first laminate (front surface side) F or the side of the second laminate (rear surface side) S that together constitute the EL lamp, as described already. Therefore, if both laminates F and S have the same light emission intensity, the difference of their transmission luminance arises between luminance of the first laminate F and luminance of the second laminate S that is viewed through the first laminate F. Therefore, the present invention uses the insulating ink for forming the first insulating layer 13 of the first laminate F, that is formed by mixing and stirring 36 g of the high dielectric material 3*a* and 48 g of the binder, in a weight ratio of 3:4, as described above. The insulating ink for forming the second insulating layer 6 of the second laminate S is prepared by mixing and stirring 60 g of the high dielectric material 6*a* and 48 g of the binder, that is, in a weight ratio of 5:4, as also described above. Therefore, there is a difference of the ratio of the high dielectric powder that is mixed with the respective insulating layer to be formed. In other words, the dielectric constants at the time of light emission of the first and second laminates F and S are set so that the dielectric constant of the first laminate F is smaller than the dielectric constant of the second laminate S. As a result, the difference of luminance between both laminates F and S as viewed from the side of the first laminate F is smaller than in the prior art devices.

As described above, the mixing ratio of the insulating ink of the second insulating layer 6 is (high dielectric constant material/binder) 5:4 whereas the mixing ratio of the insulating ink of the first insulating layer 13 is (high dielectric constant material/binder) 3:4 in this embodiment. However, the results of experiments reveal that the applicable range may be a binder equal to 4 to a high dielectric constant material equal to 4.5 to 2 for a reduced dielectric constant.

In an extreme case, the high dielectric material 3*a* is not mixed with the insulating ink for forming the first insulating layer 13. In other words, only the binder is formed and laminated for layer 13. In this case, the first luminescent layer 2 that is formed and laminated before the first insulating layer 13, and the first insulating layer 13, use the same binder. Therefore, this construction can be said to be analogous to the case where the thick first luminescent layer 2 has the luminescent bodies formed in the lower portion and laminated (see FIG. 7). In this case, too, the dielectric constants of the first and second laminates F and S are set so that the dielectric constant of the first laminate F at the time of light emission is smaller.

Embodiment 2:

The second embodiment is based on the concept that the ratio of the luminescent body of the first luminescent layer is equal to that of the second luminescent layer 5 and that the thickness is greater, in order to set the dielectric constant between the first and second transparent electrodes 1 and 4 to a value smaller than the dielectric constant between the second transparent electrode 4 and the rear electrode 7.

Figure 2:
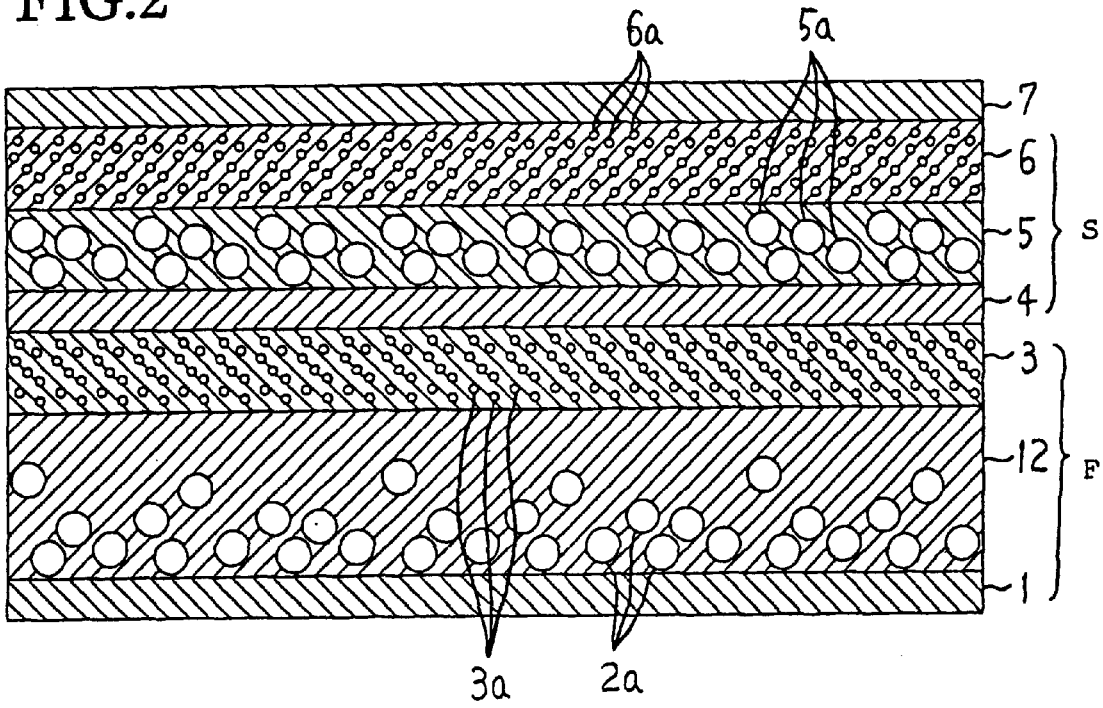
FIG. 2 is a schematic sectional view showing a multi-layered EL lamp in which a first luminescent layer (on the front surface side) is formed to a thickness greater than that of a second luminescent layer (on the rear surface side)

A first laminate F is formed by forming and laminating serially the first luminescent layer 12 and the first insulating layer 3 on the first transparent electrode 1 as shown in FIG. 2. A second laminate S is formed by forming and laminating serially the second transparent electrode 4, the second luminescent layer 5 and the second insulating layer 6 on the first insulating layer 3 of the first laminate F. Furthermore, the rear electrode 7 is formed and laminated on the second insulating layer 6 of the second laminate S to give the multi-layered EL lamp. The material for forming each layer of the first laminate F is exactly the same as the material used in Embodiment 1 with the luminescent layer 12 formed as below.

The first luminescent layer 12 will be explained in detail. After the first transparent electrode 1 is formed, the luminescent layer 12 is formed using the same luminescent ink as that of Embodiment 1 in the same way as in Embodiment 1. Subsequently, the first luminescent layer 12 in FIG. 2 is further formed by screen-printing only the fluorocarbon resin binder that does not contain the luminescent body 2*a*. This creates a thicker layer 12 with the luminescent bodies 2*a* in the lower portion as shown in FIG. 2.

In the second embodiment, the mixing ratio of the high dielectric material and the binder for the insulating ink used for forming and laminating the first insulating layer 3 is the same as that of the second insulating layer 6.

In the construction of the second embodiment, the difference of thickness exists between the luminescent layers 12 and 5 formed in laminates F and S, respectively, and the dielectric constant of the first laminate F is smaller than that of the second laminate S. Therefore, the difference of luminance as viewed from the first laminate side F at the time of light emission of both laminates F and S can be improved much more than in the prior art devices.

Figure 3:
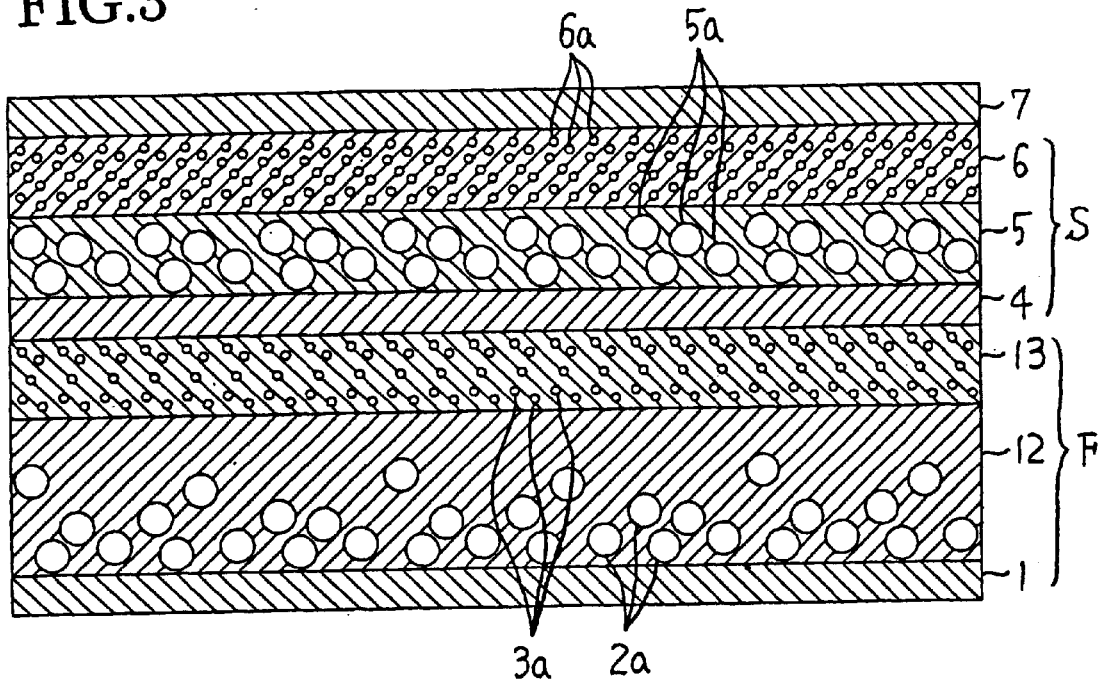
FIG. 3 is a schematic sectional view showing a multi-layered EL lamp in which the amount of a high dielectric material to be mixed in a first insulating layer is smaller than in a second insulating layer, and a first luminescent layer is formed to a thickness greater than that of a second luminescent layer.

FIG. 3 shows a modified embodiment that is achieved by adding the concept of the first embodiment to the concept of the second embodiment. The amount of the high dielectric material mixed in the first insulating layer of the first (front) laminate is smaller than the amount of the high dielectric material mixed in the second insulating layer of the second (back) laminate. In addition, the ratio of the luminescent bodies in the first luminescent layer 12 is equal to that of the second luminescent layer 5 but the thickness is greater for luminescent layer 12. Furthermore, the dielectric constant for the first laminate F can be made further smaller, and the transmission factor of the first laminate F can be improved. In this case, the insulating layers 6 and 13 are formed by using the same material and by the same method as in the first embodiment of FIG. 1 and the luminescent layers 5 and 12 are formed by using the same material and by the same method as in the second embodiment of FIG. 2.

Embodiment 3:

The third embodiment is based on a concept different from those of the first and second embodiments. This embodiment makes it possible to set the dielectric constant between the first transparent electrode 1 and the second transparent electrode 4 to a value smaller than the dielectric constant between the second transparent electrode 4 and the rear electrode 7. This embodiment is based on the concept that a greater quantity of light emitted by the second laminate S itself is allowed to transmit through the first laminate F.

Figure 4:
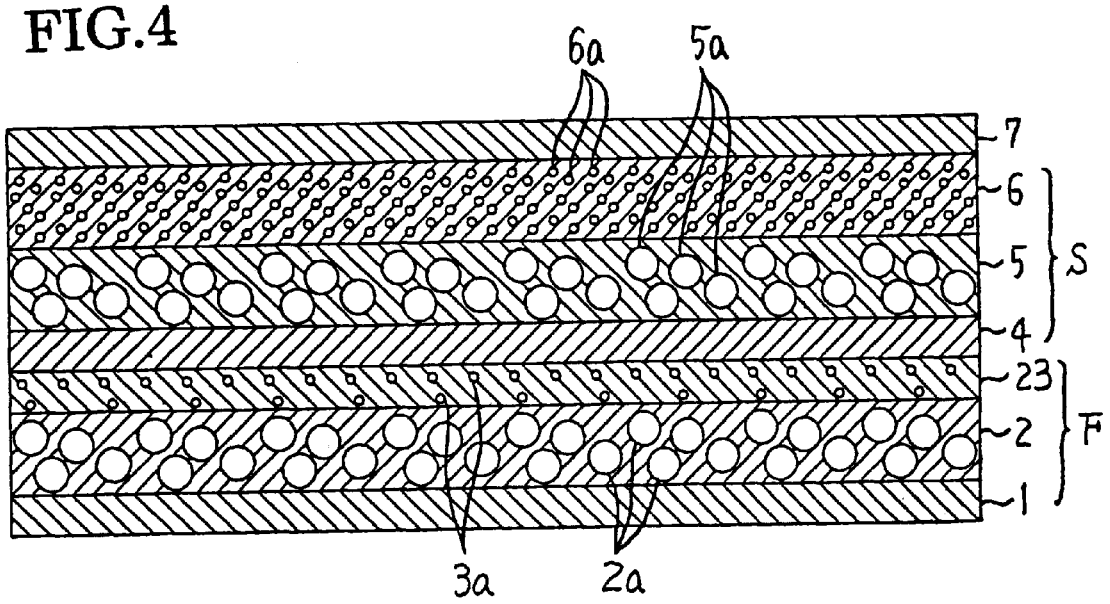
FIG. 4 is a schematic sectional view showing a multi-layered EL lamp in which the amount of a high dielectric material to be mixed in a first insulating layer is smaller than in a second insulating layer, and the first insulating layer is formed to a smaller thickness.

A first luminescent layer 2 and the first insulating layer 23 are serially formed and laminated on the first transparent electrode 1 to give a first laminate F as shown in FIG. 4. A second transparent electrode 4, a second luminescent layer 5 and a second insulating layer 6 are serially formed and laminated on the first insulating layer 23 of the first laminate F to form the second laminate S. A rear electrode 7 is formed and laminated on the second insulating layer 6 of the second laminate S to produce the multi-layered EL lamp. The material for forming each layer of the first laminate F is the same as that of the first embodiment with the first insulating layer 23 formed as below.

The first insulating layer 23 will be explained in detail. The first insulating layer 23 is formed after the formation of the first luminescent layer 2 by using the same insulating ink as the insulating ink used for the first insulating layer 13 of the first embodiment. Namely, this insulating ink has a smaller mixing amount of the high dielectric material than in the insulating ink for the second insulating layer 6 to be formed subsequently. Furthermore, the first insulating layer 23 is formed by screen printing to a film thickness smaller than that of the first insulating layer 13 of the first embodiment.

In the EL lamp in general, the electrostatic capacitance is likely to increase when the insulating layer is thinner, and luminance is likely to become higher. In the embodiment shown in FIG. 4, however, the mixing amount of the high dielectric material of the first insulating layer 23 is smaller than in the second insulating layer 6. Therefore, luminance of the first laminate F does not necessarily become higher even when the insulating layer is thinner. In the multi-layered EL lamp, transmission luminance on the rear surface side through the front surface side that has a smaller thickness becomes higher. In other words, the effect that the difference of luminescence between the front surface side and the rear surface side as viewed from the front surface side can be expected to decrease. Therefore, the effect of the concept of this third embodiment can be expected most greatly when the insulating layer is formed to a small thickness in the laminate on the front surface side.

Figure 5:
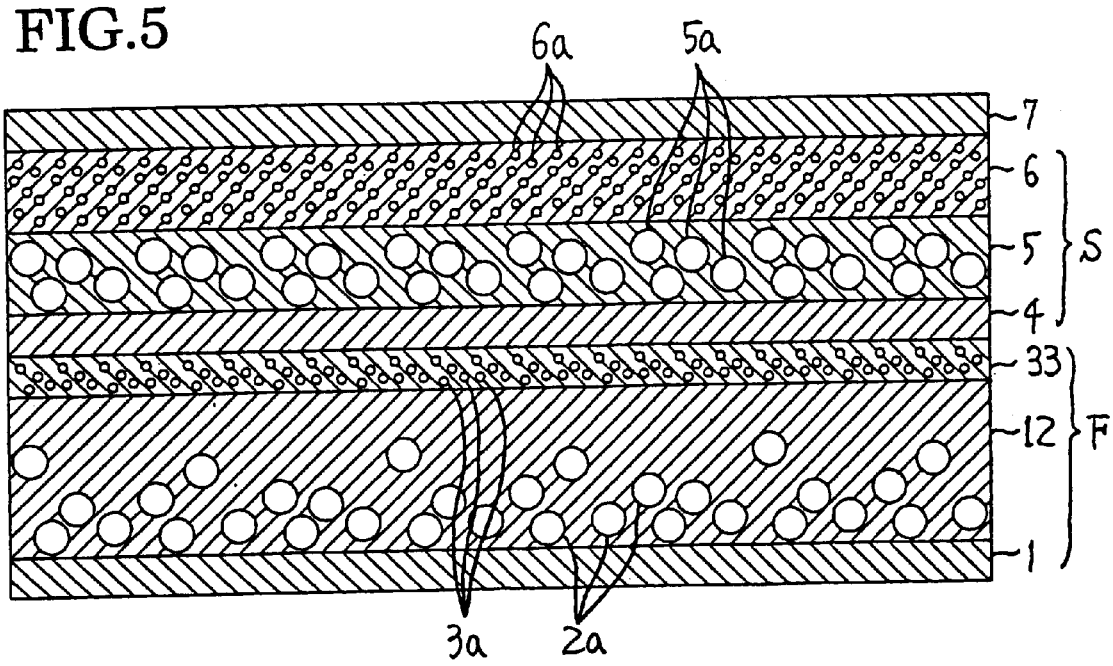
FIG. 5 is a schematic sectional view showing a multi-layered EL lamp in which a first luminescent layer is formed to a thickness greater than that of a second luminescent layer, and a first insulating layer is formed to a smaller thickness.

A first luminescent layer 12 and a first insulating layer 33 are serially formed and laminated on the first transparent electrode 1 as shown in FIG. 5 on the basis of the concept of the third embodiment. A second transparent electrode 4, a second luminescent layer 5 and a second insulating layer 6 are formed and laminated serially on the first insulating layer 33 of the first laminate F. A rear electrode 7 is then formed and laminated on the second insulating layer 6 of the second laminate S to give the multi-layered EL lamp. As for the material for forming each layer of the first laminate F, the first luminescent layer 12 uses the same material as that of the second embodiment as shown in FIG. 2. The first insulating layer 33 has the same mixing amount of the high dielectric material as that of the second insulating layer 6, but is formed to a smaller thickness by printing. The other layers are exactly the same as those of the first embodiment.

The first luminescent layer 12 in the embodiment shown in FIG. 5 is formed to a large thickness, but luminescence of the first laminate F does not necessarily become higher even though the insulating layer 33 is formed to a small thickness. In the multi-layered EL lamp, transmission luminance of the rear surface side through the thin front surface side becomes high. In other words, the effect that the difference of luminance between the front surface side and the rear surface side as viewed from the front surface side can be expected to decrease in the EL lamp shown in FIG. 5.

Figure 6:
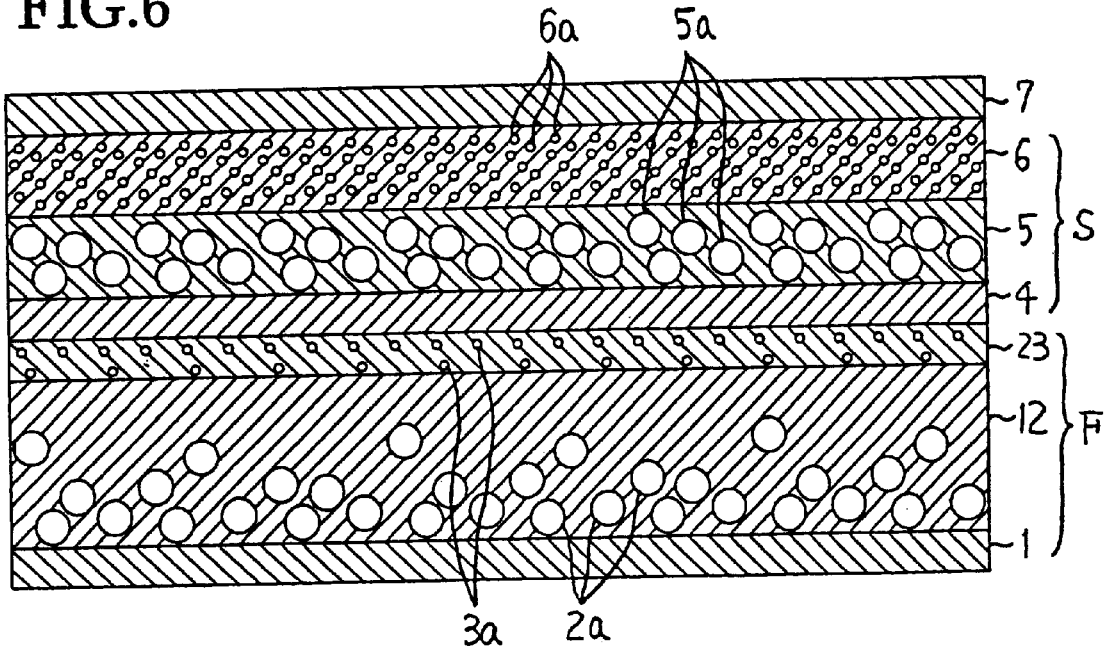
FIG. 6 is a schematic sectional view showing a multi-layered EL lamp in which the amount of a high dielectric material to be mixed in a first insulating layer is smaller than in a second insulating layer, a first luminescent layer is formed to a thickness greater than that of a second luminescent layer, and the first insulating layer is formed to a smaller thickness.

FIG. 6 shows a modified embodiment comprising the combination of the concepts of FIGS. 4 and 5. In other words, in FIG. 6 the mixing amount of the high dielectric material in the first insulating layer 23 is decreased as in FIG. 4 and the first luminescent layer 12 is formed to a large thickness.

Figure 7:
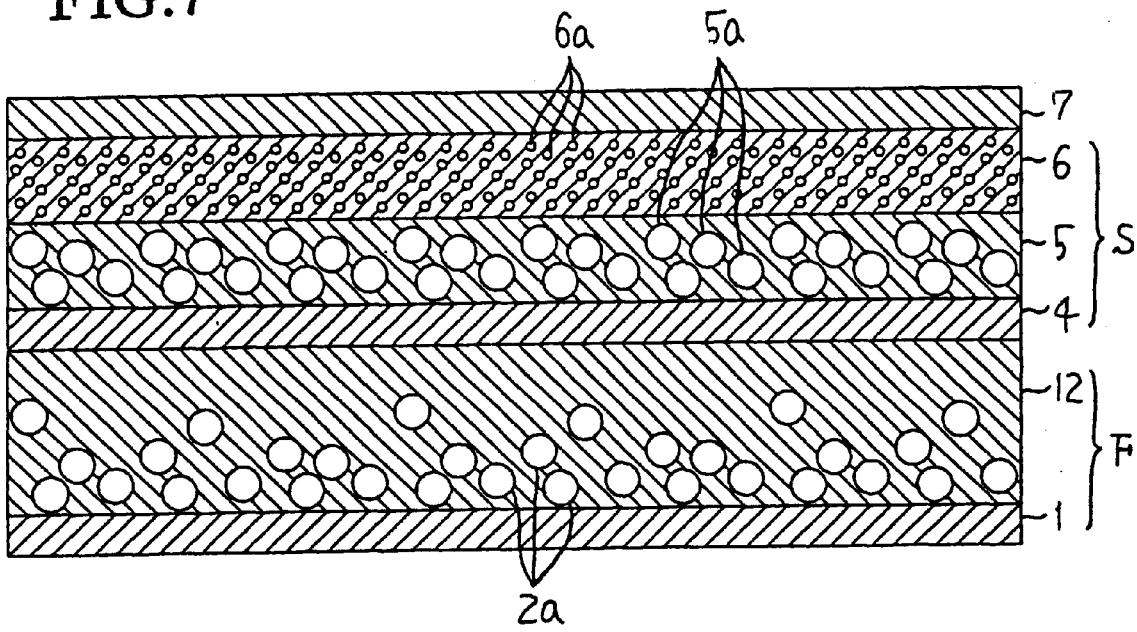
FIG. 7 is a schematic sectional view showing a multi-layered EL lamp in which a first luminescent layer is formed to a thickness greater than that of a second luminescent layer, and an insulating layer between the first luminescent layer and the second luminescent layer is omitted.

FIG. 7 shows an El lamp in which the first luminescent layer 12 is formed as in the second embodiment shown in FIG. 2 having a greater thickness than the second luminescent layer 5 and an insulating layer between the first luminescent layer 12 and the second luminescent layer 5 is omitted.

Though the present invention has thus been explained about the multi-layered EL lamp having the two-phase (laminate) construction, the present invention can be applied obviously to multi-layered EL lamps having three or more layers (i.e. laminates).

Though the present invention has been explained referring to luminescence of the multi-layered EL lamp, the present invention can be applied obviously to a multi-layered EL lamp of a multi-color luminescence type.

Table 1 shows for a related art structure of a mere two-layered multi-layered EL lamp and for each structure shown in drawings of the invention, luminance (cd/m$^2$) 100 V and 400 Hz, a luminance ratio (rear surface side/front surface side) of each EL lamp and a transmission factor (%) of the first laminate F.

TABLE 1

| Specification | Luminance (cd/m$^2$) (100 V, 400 Hz) At the time of emission of first laminate F | At the time of emission of second laminate S | Luminance ratio (rear surface/front surface) | Transmission factor of first laminate F (%) |
|---|---|---|---|---|
| Related art type | 61.6 | 17.5 | 0.28 | 24 |
| FIG. 1 type | 53.4 | 19.3 | 0.36 | 27 |
| FIG. 2 type | 50.6 | 17.9 | 0.35 | 25 |
| FIG. 3 type | 48.3 | 18.6 | 0.38 | 26 |
| FIG. 4 type | 58.7 | 21.6 | 0.37 | 30 |
| FIG. 5 type | 56.4 | 18.8 | 0.33 | 26 |
| FIG. 6 type | 65.3 | 26.6 | 0.41 | 36 |
| FIG. 7 type | 47.7 | 46.3 | 0.97 | 61 |

As explained above, the present invention makes it possible to decrease the difference of transmission luminance between the front surface side and the rear surface side as viewed from the front surface side, by adjusting the dielectric constants on the front surface side and the rear surface side of the multi-layered EL lamp.

The difference of luminescence can be adjusted by adjusting the weight ratio of the high dielectric material to be mixed in the first and second insulating layers, or by adjusting the film thickness of the luminescent layers or the insulating layers.

After the dielectric constants on the front surface side and the rear surface side are adjusted, the thickness of the insulating layer is decreased to adjust the difference of luminescence between the front surface side and the rear surface side. The reduction of the thickness of the insulating layer is most effective for adjusting the transmission factor on the front surface side.

What is claimed is:

1. A method of making an EL lamp comprising:

serially laminating a first transparent electrode, and a first luminescent layer to form a first laminate;

serially laminating a second transparent electrode, a second luminescent layer and an insulating layer on said first laminate to form a second laminate; and forming a rear electrode on said laminate;

wherein a dielectric constant between said first transparent electrode and said second transparent electrode is set to a value smaller than a dielectric constant between said second transparent electrode and said rear electrode.

2. A method of making an EL lamp according to claim 1, further comprising forming said first laminate by serially laminating an insulating layer; a high dielectric material in said insulating layer having a lower weight ratio than a high dielectric material in said insulating layer of said second laminate.

3. A method of making an EL lamp according to claim 1, wherein the thickness of said first luminescent layer is greater than the thickness of said second luminescent layer.

4. A method of making an EL lamp according to claim 2, wherein a high dielectric material is mixed into said insulating layer of said laminate which is not greater than 90% in terms of a weight ratio to a high dielectric material which is mixed into said second insulating layer.

5. A method of making an EL lamp according to claim 3, wherein said first luminescent layer is formed with luminescent bodies concentrated in a lower portion.

6. A method of making an EL lamp according to claim 1, wherein the thickness of said first luminescent layer is 130 to 250% of the thickness of said second luminescent layer.

7. A method of making an EL lamp according claim 2, wherein the thickness of said first luminescent layer is greater than the thickness of said luminescent layer of said second laminate.

8. A method of making an EL lamp according to claim 1, further comprising forming said first laminate by serially laminating an insulating layer; the thickness of the insulating layer of said first laminate formed to be less than the thickness of said insulating layer of said second laminate.

9. A method of making an EL lamp according to claim 2, wherein the thickness of the insulating layer of said first laminate formed to be less than the thickness of said insulating layer of said second laminate.

10. A method of making an EL lamp according to claim 8, wherein the thickness of said insulating layer of said first laminate is not greater than 90% of the thickness of said insulating layer of said second laminate.

11. A method of making an EL lamp according to claim 3, wherein the step of forming said first luminescent layer is comprised of forming a layer of a luminescent ink having luminescent bodies in a resin binder and forming a layer of resin binder.

12. An EL lamp according to claim 11, wherein the layer of resin binder is an insulating layer.

13. A method of making an EL lamp according to claim 2, wherein the weight ratio of said high dielectric material in said insulting layer of said first laminate is essentially zero.

* * * * *